United States Patent [19]

Takesue

[11] 4,039,408

[45] Aug. 2, 1977

[54] METHOD OF ELECTROLYTICALLY RECOVERING ZINC

[75] Inventor: Tatsuo Takesue, Shimonoseki, Japan

[73] Assignee: Mitsui Mining & Smelting Co., Ltd., Tokyo, Japan

[21] Appl. No.: 701,127

[22] Filed: June 30, 1976

[30] Foreign Application Priority Data

July 7, 1975 Japan ..... 50-83260

[51] Int. Cl.[2] ..... C25C 1/16

[52] U.S. Cl. ..... 204/119

[58] Field of Search ..... 204/119

[56] References Cited

U.S. PATENT DOCUMENTS 3,826,648 7/1974 Bodson ..... 204/119

*Primary Examiner*—R. L. Andrews

[57] ABSTRACT

A method of electrolytically recovering zinc is described wherein the pH value of a neutral leaching solution is adjusted to about 1 to 3 before being mixed with a circulating electrolyte, a downward stream of the neutral leaching solution in the form of a spray within a first gas-liquid contact type cooling tower is supplied, an upward stream of cooling gas is supplied under pressure at high speed from a lower part of the cooling tower in countercurrent relation to the downward stream of neutral leaching solution, thereby subjecting balls of light weight which are packed within the cooling tower to floating and rotating movement for bringing the neutral leaching solution in the cooling contact with the cooling gas on the surface of the balls so as to cool the neutral leaching solution while, at the same time, removing impurities depositing in gel form on the balls by utilizing the self-cleaning action of the balls. The cooled neutral leaching solution is added to supplement the part of the circulating electrolyte discharged from a circulating tank, and a downward stream of solution mixture in spray form is supplied within a second gas-liquid contact type cooling tower in countercurrent relation with an upward stream of cooling gas, thereby subjecting similar balls to floating and rotating movement, thereby cooling the solution mixture while removing impurities.

4 Claims, 13 Drawing Figures

METHOD OF ELECTROLYTICALLY RECOVERING ZINC

BACKGROUND OF THE INVENTION

This invention relates to a method of cooling an electrolyte circulating through an electrolyzing section of a chemical plant used for the electrowinning or electrolytic recover of zinc.

In the electrowinning of a metal, such as zinc, using a suitable electrolyte, the electrolyte is generally subjected to a temperature rise due to the heat generated during the electrolysis. Such a rise in the temperature of the electrolyte is especially undesirable for the successful electrowinning of zinc due to the fact that the lead anodes usually employed are subjected to corrosion and the metal electrodeposited on the cathodes tends to be re-dissolved into the electrolyte as a result of attack by impurities existing in the electroylte, resulting in undesirable degradation of the quality of the product and undesirable reduction of the current efficiency. It is therefore essential to maintain a constant temperature of the electrolyte and at a desired low level in order to improve the efficiency of the electrolysis.

Various methods have hitherto been proposed for effectively cooling the electrolyte used for the electrowinning of zinc. These prior art methods include an indirect cooling method, a self-vaporizing method, a vacuum vaporizing method, and a direct cooling method. However, the first or indirect cooling method using a heat exchanger is defective in that a very large heat exchange area is required for effectively cooling the electroylte by a cooling medium, and the cooling medium may leak into the electrolyte when the heat exchanger is corroded. This method is further defective in that the cooling efficiency is not so high.

The second or self-vaporizing method is defective in that a very large amount of cooling water is required for condensing the water vapor produced by vaporization.

The third or vaccum vaporizing method, using a vacuum pump, is defective in that troublesome maintenance often results from use of a vacuum pump. Further, this third method is not so effective for use in some geographical areas where the temperature of local cooling water is relatively high.

The fourth or direct cooling method using air for heat exchange is defective in that the efficiency of heat exchange is quite low and troublesome maintenance is required for the heat exchanger. Further, these prior art methods have the common defficiency that hydrates of impurities such as $CaSO_4$, $K_2SO_4$, $MgSO_4$, $Na_2SO_4$, $MnSO_4$ and $SiO_2$ existing in the electrolyte or neutral leaching solution tend to precipitate in gel form, and such impurities in gel form tend to deposit on the interior surfaces of the cooling apparatus. This deposition is objectionable in that not only the efficiency of heat exchange is lowered, but also, clogging of the conduits and other parts of the cooling apparatus result. Further, the impurities have a tendency to solidify and difficulty is encountered in removing the solids resulting from such solidification.

SUMMARY OF THE INVENTION

It is an object of the present invention to provide a novel and improved method of cooling an electrolyte circulated in the course of the electrowinning of zinc.

In accordance with one aspect of the present invention, there is provided a method of cooling an electrolyte circulated for the electrolytic refining or electrowinning of zinc, comprising the steps of initially cooling a neutral leaching solution to be added to said circulating electrolyte to a first temperature relatively close to a second temperature suitable for the electrolysis of said electrolyte while, at the same time, removing impurities existing in said neutral leaching solution by causing the impurities to precipitate in gel form during the cooling, and then further cooling said circulating electrolyte mixed with said neutral leaching solution to said second temperature while, at the same time, removing impurities existing in said circulating electrolyte, by causing the impurities to precipitate in gel form during the cooling.

In accordance with another aspect of the present invention, there is provided a method of the above character, wherein means are provided for removing the impurities existing in said neutral leaching solution and said circulating electrolyte while cooling said solutions, said means comprising a cooling tower having means for supplying a downward stream of said neutral leaching solution or said circulating electrolyte in the form of a spray within said cooling tower, means for forceably supplying an upward stream of cooling gas under pressure in counter-current relation with the downward stream of said neutral leaching solution or said circulating electrolyte, and a multiplicity of balls of light weight packed in a suitable area within said cooling tower, said balls being subjected to floating and rotating movement created by said upward stream of cooling gas flowing in counter-current relation to said downward stream of said neutral leaching solution or said circulating electrolyte, thereby bringing said neutral leaching solution of said circulating electrolyte into cooling contact with said cooling gas, said balls further making frictional engagement with one another thereby removing the impurities precipitating from said neutral leaching solution or said circulating electrolyte and depositing in gel form on the surface of said balls during cooling.

In accordance with still another aspect of the present invention, there is provided a method of the above character, wherein a plurality of vertically arranged packing chambers are formed by a plurality of vertically spaced grids within said cooling tower to contain said balls therein in such relation that the voids of said packing chambers when packed with said balls are from about 60% to 95% by volume, and said grids are each formed by fixing a knotless net having a mesh size of from about 40 to 50mm to a supporting frame.

FIGS. *7a, 7b, 7c* and FIGS. *8a, 8b, 8c, 8d* are graphs showing the marked cooling effect according to the method of the present invention.

DETAILED DESCRIPTION OF THE INVENTION

A cooling system preferably employed in the practice of the cooling method according to the present invention will be described in detail with reference to a flow sheet shown in FIG. 1.

Figure 1:
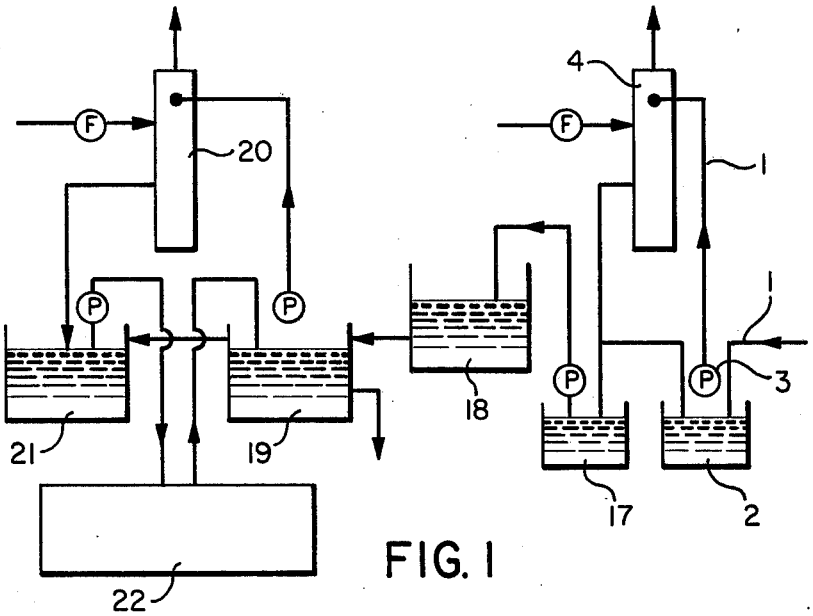
FIG. 1 is a flow sheet showing a cooling system preferably employed in the practice of a preferred embodiment of the cooling method according to the present invention.

Referring to FIG. 1 showing a cooling system in an electrowinning zinc plant, the cooling system comprises a conduit 1 for supplying a purified neutral leaching solution (zinc sulfate solution) from a purifying section into a first sump tank 2, and a pump 3 for forceably feeding the purified neutral leaching solution from the first sump tank 2 into a first cooling tower 4 having an unique structure described later with reference to FIG. 2.

The temperature of the purified neutral leaching solution supplied from the purifying section is generally of the order of 60° C to 50° C and is thus far higher than the temperature of a circulating electrolyte which is generally about 35° C. Therefore, the neutral leaching solution must be precooled to the temperature suitable for the electrolysis before it is added to the circulating electrolyte. Further, due to the fact that impurities such as Ca, K, Mg, Na, Mn and Si in an amount of about 9 to 36 g/l exist in the neutral leaching solution, a part of these impurities deposit as a gel during the cooling step. In other words, in the purified neutral leaching solution, the impurities such as Ca, K, Mg, Mn, Na and Si are present in the form of sulfate, for instance Ca deposit as the form of hydrates of $CaSO_4$—$H_2SO_4$ during the reduction of the temperature of the neutral leaching solution from about 65° C to about 35° C.

The cooling tower 4 employed in the present invention comprises means for removing the impurities existing in the neutral leaching solution by converting the same to gel form. This cooling tower 4 is preferably of the gas-liquid contact type in which balls of light weight are packed to produce turbulent contact between a gas and a liquid. The hydrates, such as $CaSO_4$, $K_2SO_4$, $MgSO_4$, $Na_2SO_4$ and $MnSO_4$ have the softness suitable for effective removal when the pH value of the neutral leaching solution is in the order of 2. Therefore, the pH value of the neutral leaching solution is preferably adjusted to about 2 in order to promote removal of the hydrates of such impurities.

The pH value of the purified neutral leaching solution is about 2 ± 1 in the case wherein cobalt is removed by adding $\beta$ -naphthol or $\alpha$ -nitroso- $\beta$ -naphthol to purify the neutral leaching solution. In such an event, the neutral leaching solution can be directly supplied to the cooling tower 4 without any pH adjustment. However, in the case in which powdery $As_2O_3$–Zn is added to purify the neutral leaching solution, the pH value of the purified neutral leaching solution is about 4–5. In this latter case, an electrolyte, of which the sulfuric acid concentration is about 100–180 g/l, is added to the purified neutral leaching solution to adjust the pH value thereof to about 2.

U.S. Pat. No. 3,122,594 discloses a cooling tower, the interior of which is partitioned by a plurality of grids to form a plurality of packing chambers each packed with balls of light weight. In this cooling tower, nozzles are disposed at an upper internal part for spraying a liquid, and a gas is fed upwardly from a lower internal part in counter-current relation, thereby bringing the gas into contact with the liquid in the packing chambers packed with the balls, so that undesirable clogging can be avoided and pressure losses can be reached to a minimum by preventing deposition of solids on the ball surface utilizing the frictional engagement of the balls with one another.

The present invention intends to fully utilize the self-cleaning action of such balls so as to positively achieved both the effective cooling of the electrolyte and the effective removal of impurities included in the electrolyte. To this end, the pH value of the purified neutral leaching solution is adjusted to about 2 in the pre-treatment step as above described, and the cooling tower 4 has an improved structure as shown in FIG. 2.

Figure 2:
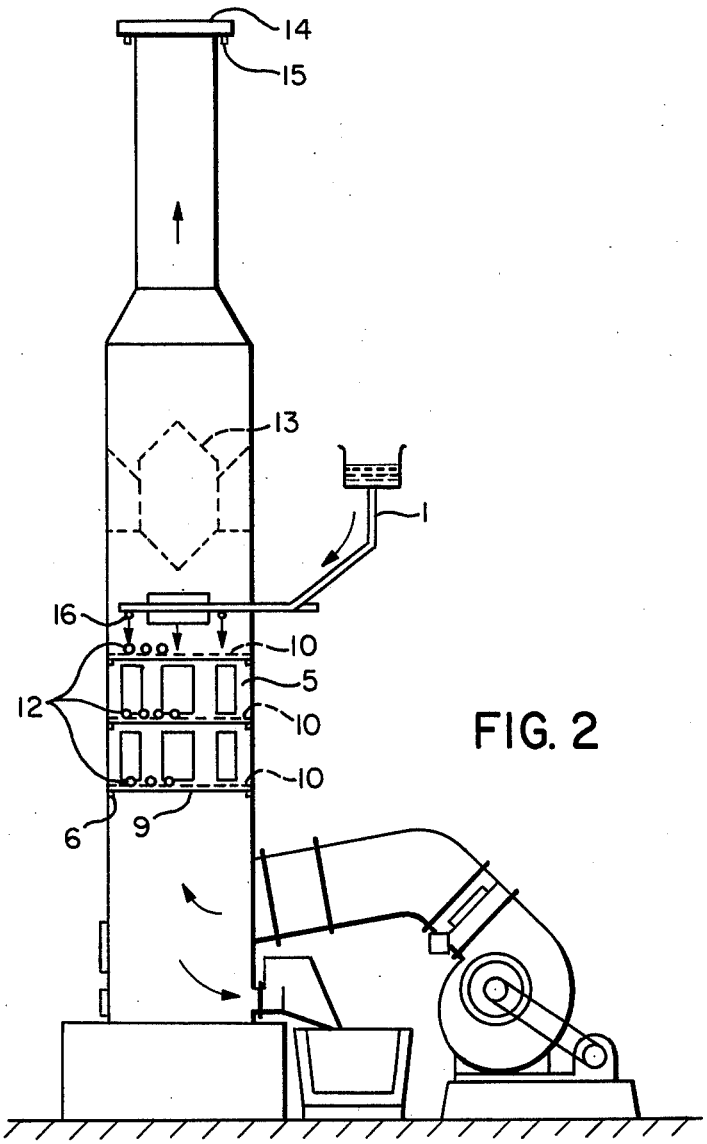
FIG. 2 is a schematic vertical sectional view of a cooling tower preferably employed in the cooling system according to the present invention.
Figure 3:
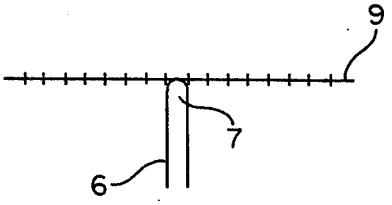
FIG. 3 is a schematic enlarged view of part of means for holding a grid within a cooling tower.
Figure 4:
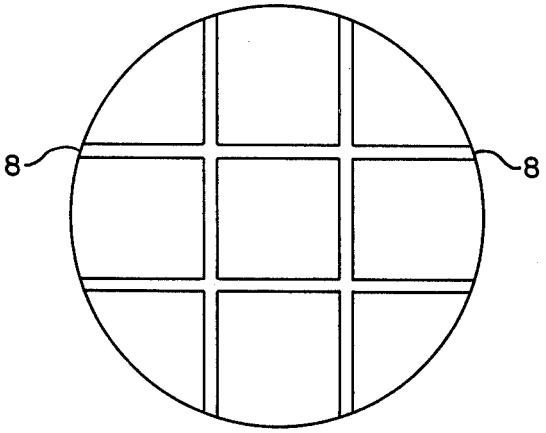
FIG. 4 is a schematic plan view of a frame for supporting a knotless net thereon to form a grid.
Figure 5:
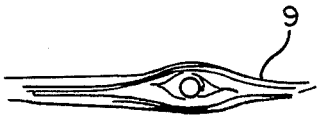
FIG. 5 is a schematic sectional view of part of a knotless net used in the present invention.
Figure 6:
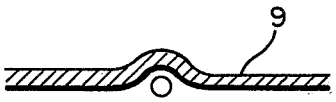
(PRIOR ART) FIG. 6
FIG. 6 is a view similar to FIG. 5, but showing the structure of a prior art grid using a conventional net.
Figure 7A:
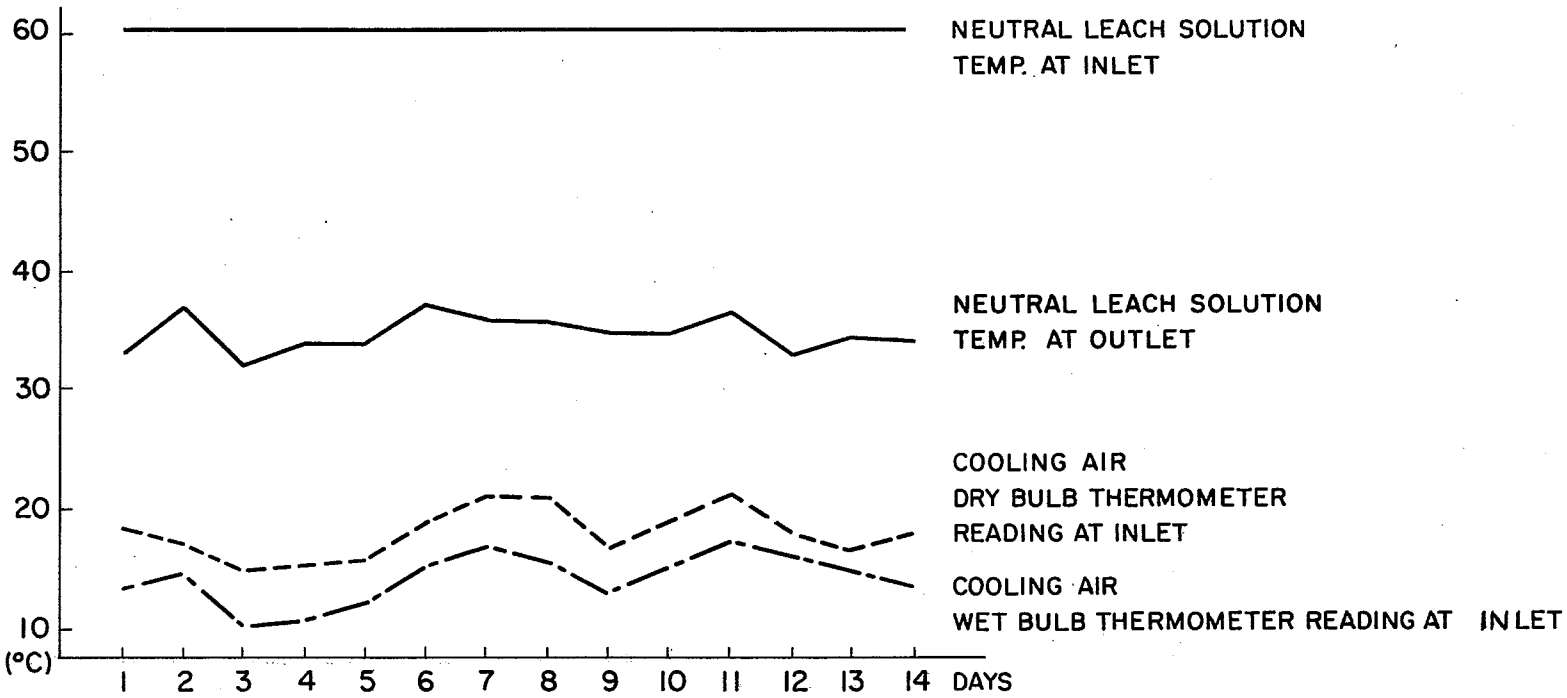
Figure 7B:
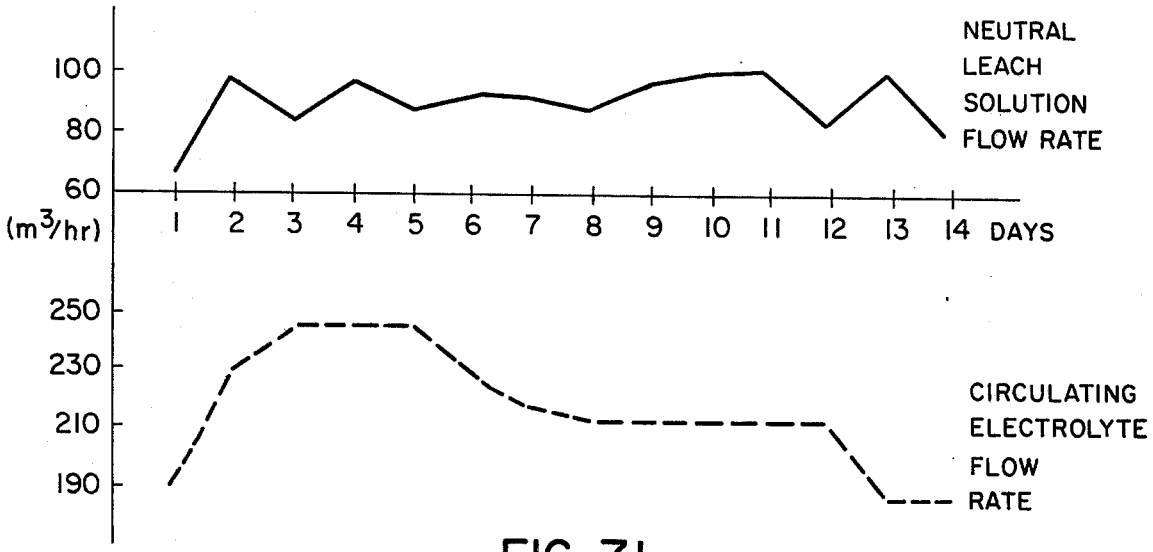
Figure 7C:
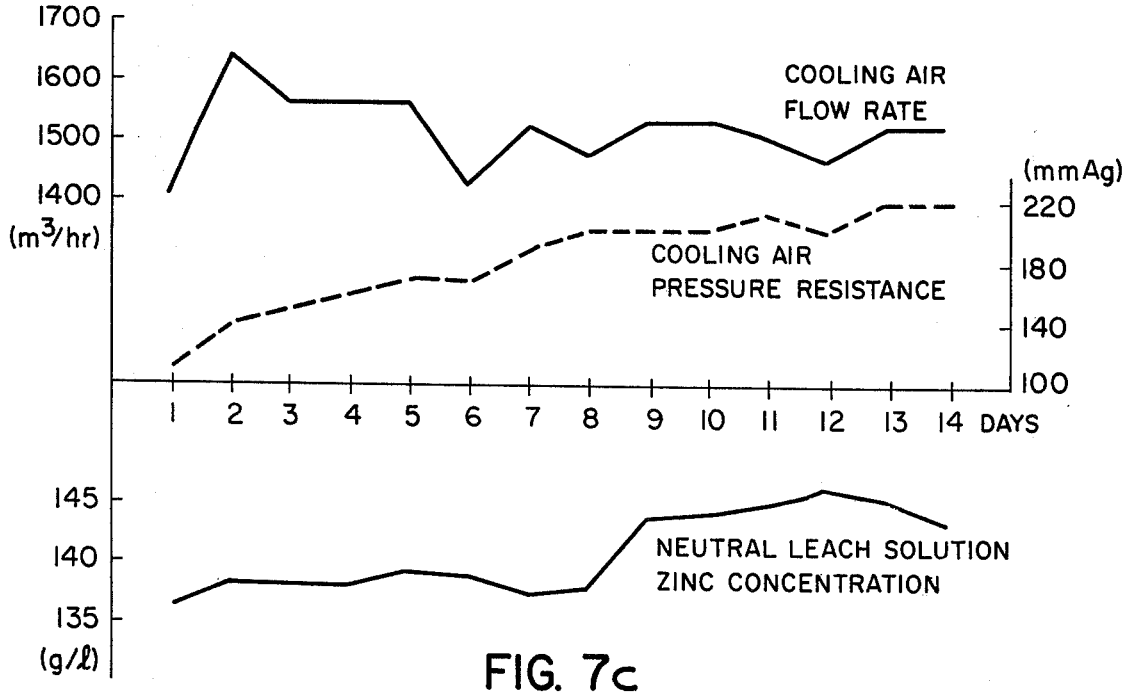
Figure 8A:
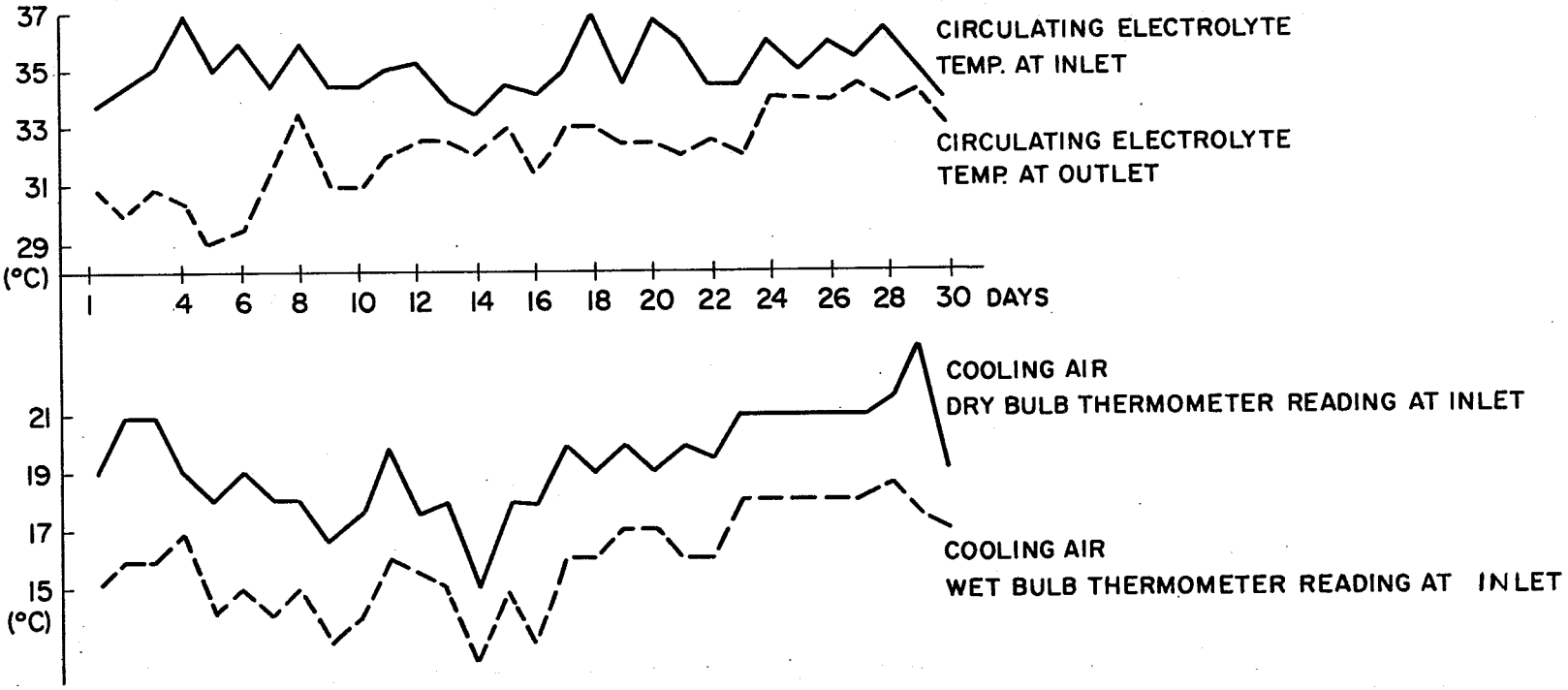
Figure 8B:
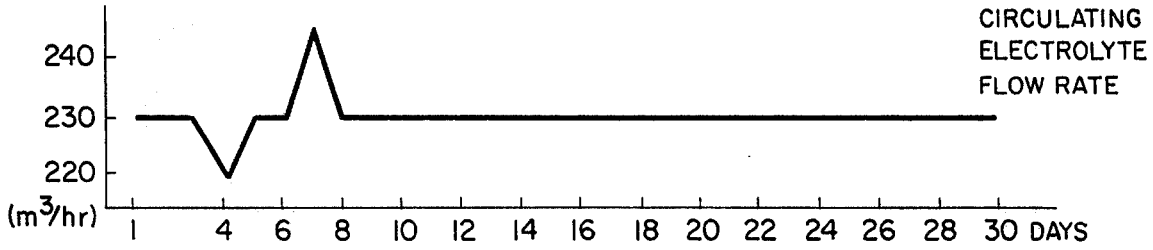
Figure 8C:
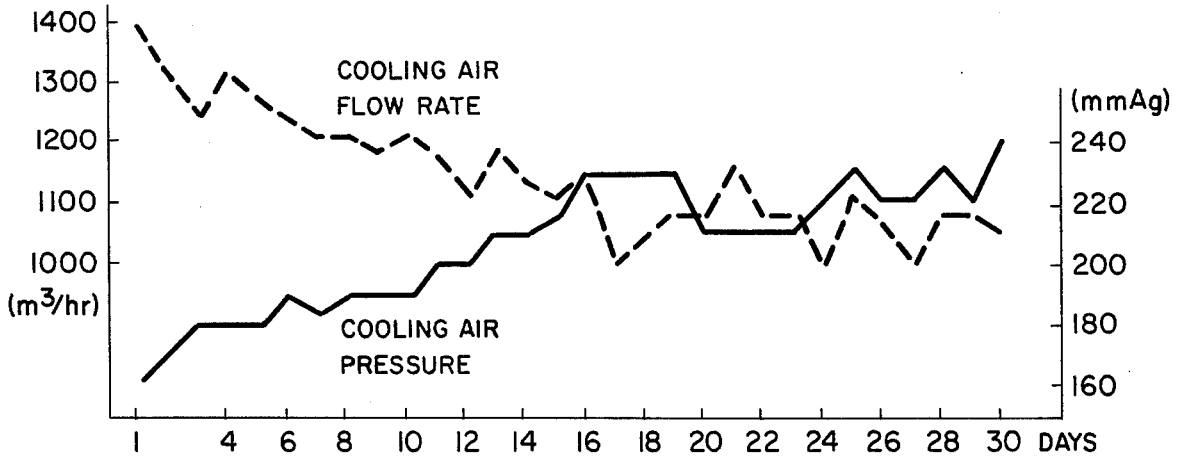
Figure 8D:
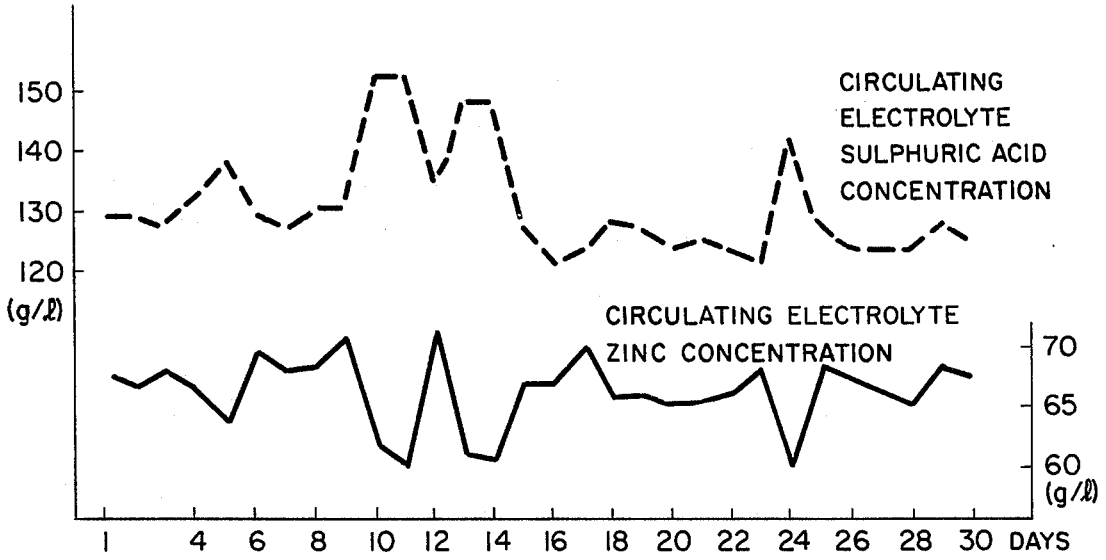

Referring to FIG. 2, the gas-liquid contact type cooling tower 4 comprises a plurality of vertically arranged packing chambers 5 disposed substantially in the middle of the tower, and a centrifugal mist eliminator 13 disposed above the stack of the packing chambers 5. A drain separator 14 is disposed on the top end of the cooling tower 4, and a drain discharge port 15 communicates with the drain separator 14. Holding members 6 are disposed on the inner wall of the cooling tower 4 for fixably retaining on the upper end 7 thereof a grid frame 8 as shown in FIG. 3. This grid frame 8 has a structure as shown in FIG. 4 and is fixed to the holding members 6 to extend across the interior of the cooling tower 4. A knotless net 9 is fixed under tension to the grid frame 8 to constitute a grid 10 which provides the bottom of each packing chamber 5. As shown in FIG. 5, this knotless net 9 is formed by covering the cores of a network with a suitable covering material in such a manner as to completely enclose the knots and has therefore smooth upper and lower surfaces. In a prior art net structure as shown in FIG. 6, material in gel form tend to be arrested in the recess portion 11 of the knot. However, such phenomenon does not occur in the net 9 having the structure shown in FIG. 5. The material of the knotless net 9 is polyethylene, which is not attacked by the neutral leaching solution. It is apparent, however, that the material is in no way limited to polyethylene, and any other suitable corrosion-resistant material, such as nylon, may be used.

A multiplicity of balls 12 of light weight are packed in the packing chambers 5 partitioned by the grids 10. These balls 12 have such a light weight that they facilitate flotation and rotational movement by virtue of being urged by an upward stream of a cooling gas. For example, balls 12 are advantageously hollow spherical bodies of polypropylene having a wall thickness of about 0.8 to 1.0 mm.

The amount of the neutral leaching solution added to the circulating electrolyte is generally of the order of 90 to 180 $m^3$/hr. In order that the neutral leaching solution supplied in such an amount can be cooled to the predetermined temperature, the flow rate of the cooling gas flowing upwardly through the cooling tower 4 is preferably in the order of about 90,000 $m^3$/hr. Therefore, taking into account these flowing rates of the cooling gas and neutral leaching solution, cooling efficiency, packed density of the balls, degree of deposition of impurities in gel form and pressure losses, the packing chambers 5 are preferably arranged over two or three stages, each having a vertical height of 1200 mm, and the voids are preferably about 60% to 95% as shown in the following table:

| When arranged over two stages | Packed height of balls | Void % |
|---|---|---|
| Upper stage | 200 - 400 | 82 - 63 |
| Lower stage | 100 - 300 | 90 - 73 |
| When arranged over three stages | | |
| Upper stage | 60 - 200 | 95 - 82 |
| Intermediate stage | 150 - 400 | 86 - 63 |
| Lower stage | 100 - 300 | 90 - 73 |

The packed density of the balls in the upper packing chamber 5 may be less than that shown in the above table due to the fact that the solution can be better distributed in the upper chamber 5 than in the lower and intermediate chambers 5.

The size or diameter of the meshes of the net 9 is generally preferably selected to be about 40 to 50 mm under the operating conditions above described, when the factors including the degree of deposition of impurities in gel form and pressure losses are taken into account as in the case of determination of the packed density of the balls. A considerable pressure loss may occur and the effects of cooling and impurity removal may be extremely lowered when the packed density of the balls is excessively high and the size of the meshes of the net is excessively small. On the other hand, when the packed density of the balls is excessively low and the size of the meshes of the net is excessively large, the cooling gas may not be sufficiently brought into cooling contact with the solution, and the self-cleaning action of the balls may not be sufficient, resulting similarly in substantial lowering of the effects of cooling and impurity removal.

The temperature of the purified neutral leaching solution supplied from the purifying section and stored in the sump tank 2 is about 60° C to 50° C as above described. The pH value of the purified neutral leaching solution is adjusted to about 2± 1, and then the neutral leaching solution is sprayed into the cooling tower 4 from spray nozzles 16 of a spray pipe. On the other hand, the cooling gas, which may be at air or room temperature, is forceably supplied by a blower into the cooling tower 4 in counter-current relation with the neutral leaching solution flowing down in spray form. In this case, the neutral leaching solution is preferably sprayed at a rate of 1.0 to 2.0 l per $m^3$ of the cooling gas. The balls 12 packed in the packing chambers 5 are at the same time urged into a floating and rotating movement, or so-called turbulent motion, by means of the upwardly flowing stream of the cooling gas.

The neutral leaching solution sprayed into the cooling tower 4 from the spray nozzles 16 and flowing downwardly through the packing chambers 5 is brought into contact with the upwardly flowing stream of the cooling gas flowing in counter-current relation to be cooled thereby on the surface of the balls 12 which act as a gas-liquid contact medium. The impurities such as the sulfates of Ca, Mg, Mn, Na, K and Si existing in the neutral leaching solution precipitate in gel form accompanied by reduction in the temperature of the neutral leaching solution and attach to the surface of the balls 12. However, the deposit attaching in gel form to the surface of the balls 12 is removed from the balls 12 and does not accumulate on the surface of the balls 12 due to the repeated frictional engagement of these balls 12 with one another. Therefore, the impurities present in the neutral leaching solution can be positively removed and the clogging of the packing chambers 5 can be avoided. Further, undesirable reductions in the heat exchange efficiency and pressure losses can be minimized. Thus, the cooling of the neutral leaching solution can be effectively carried out continuously. Further, undesirable mist is not produced in a large amount. The greater part of the mist produced in the cooling tower 4 is separated from the gas in the mist eliminator 13. The mist that may still remain in a small amount can then be separated by the drain separator 14 so that the exhaust gas discharged to the atmosphere does not include any gases which will pollute the environment. The rate of concentration of the neutral leaching solution subjected to the gas-liquid contact in the manner above described is about 95%, and the pressure loss in the gas-liquid contact type cooling tower 4 is quite low, only about 150 to 230 mmAq.

As a result of the cooling, the neutral leaching solution is cooled from about 65° C to about 36° C - 38° C, and the impurities are removed about 0.04 g/l in the original valve of 9 to 36 g/l. These impurities deposit in gel form on the surfaces of the balls 12, and at the same time, the impurities depositing in gel form are removed from the surface of the balls 12 by the self-cleaning action of the balls 12 making frictional engagement with one another.

A portion of these impurities may deposit on the inner wall of the cooling tower 4 and on the nets 9 of the grids 10. The impurities depositing in gel form are quite soft due to the fact that the pH value of the neutral leaching solution is adjusted to about 2. Thus, the impurities depositing on the inner wall of the cooling tower 4 can be easily washed away by spraying washing water at a pressure of about 40 to 60 kg/$cm^2$, and the impurities accumulating on the nets 9 can be easily removed by imparting vibration to the nets 9 by physical means, such as a hammer. The nets 9 must be bonded slack-free to the individual grid frames 8 so that they can sufficiently withstand the vibration imparted thereto by the hammer. Consequently, the greater part of the impurities in gel form flow downward to settle on the bottom of the cooling tower 4. The gel settling on the bottom of the cooling tower 4 is drawn out to be stored in a sump tank (not shown) in which the gel is cooled and matured to cause crystallization of a part thereof. The gel concentrated in this manner is then turned into slurry form and is fed to a thickener in the leaching section in which zinc included in the slurry is separated to be recovered. The slurry, from which zinc is separated, is finally discharged as a waste.

The neutral leaching solution cooled in the cooling tower 4 in the manner above described is fed to a second sump tank 17, while a part of the cooled neutral leaching solution is recirculated into the first sump tank 2 again. The cooled neutral leaching solution is fed from the second sump tank 17 to a storage tank 18 to be stored therein and is subsequently transferred from the storage tank 18 to a first circulating tank 19. The electrolyte circulating through the electrolyzing section is stored in the first circulating tank 19, and a part of the circulating electrolyte supplied from the electrolyzing section is continuously extracted from the storage tank 18 at a rate of 70 to 90 $m^3$/hr to be supplied to the electrolyzing section as a spent electrolyte. When electro zinc is produced at the rate of 7000 t/month the neutral leaching solution in an amount corresponding to the amount of the extracted electrolyte is added to the circulating electrolyte in the storage tank 19. Generally, the circulating electrolyte mixed with the neutral leaching solution has a zinc concentration of about 50 to 75 g/l and a sulfuric acid concentration of about 130 to 200 g/l and contains impurities such as Mg, Mn, Ca, K, Na and Si in an amount of about 9 to 36 g/l.

The circulating electrolyte mixed with the neutral leaching solution is fed to a second gas-liquid contact type cooling tower 20 having a structure similar to that of the first cooling tower 4. In this second cooling tower 20, balls similar to the balls 12 and grids similar to the grids 10 are provided so that the electrolyte can be cooled as in the case of the neutral leaching solution utilizing the floating and rotating balls as a gas-liquid contact medium. In this case, it is preferable to supply the circulating electrolyte at a rate of 2000 to 3000 $m^3$/hr and cooling air at a rate of 6000 to 18,000 $m^3$/min so as to provide the liquid to gas ratio of 2.0 to 5.0 1/$m^3$. As a result of the above cooling treatment, the temperature of the circulating electrolyte is reduced from about 35° C – 38° C to about 30° C – 33° C. With this cooling, the impurities such as Ca, Mg, Mn, K, Na and Si present in the circulating electrolyte precipitate in the form of sulfates. Portions of these sulfate impurities precipitating in gel form from the circulating electrolyte deposit on the surface of the balls, and at the same time, are removed from the surface of the balls due to the self-cleaning action of the balls, making frictional engagement with one another. On the other hand, the remaining portions of the sulfates deposit on the inner wall of the cooling tower 20 and on the nets of the individual grids. These precipitates in gel form can be removed in a manner similar to the manner of removal described with regard to the neutral leaching solution. The circulating electrolyte cooled in the cooling tower 20 in this manner is transferred to a second circulating tank 21 to be circulated to an electrolyzing cell 22.

According to the cooling method of the present invention, impurities existing in the neutral leaching solution and circulating electrolyte precipitate in gel form and can therefore be effectively removed with cooling as described. Thus, the marked effect of the present invention is self-evident. According to the cooling method of the present invention, therefore, there is utterly no possibility of giving rise to clogging and other troubles in the conduits connected to the cooling towers, and it is possible to prevent troubles that may be encountered during electrolysis, for example, an undesirable reduction of the efficiency of electrolysis due to increase of cell voltage caused by the accumulation of impurities such as $Mg^{+2}$ in the electrolyte.

A practical example of the cooling system employing the cooling method according to the present invention will now be described.

EXAMPLE 1

A neutral leaching solution having a composition as shown in Table 1 was supplied at a rate of 103 $m^3$/hr to the gas-liquid contact type cooling tower which had dimensions as shown in Table 2, was sprayed from the spray nozzles disposed in the cooling tower. Seven spray nozzles were provided on three spray pipes of polyvinyl chloride so as to uniformly spray the neutral leaching solution into the cooling tower.

Table 1

| | |
|---|---|
| Zinc concentration (g/l) | 130–150 |
| Sulfuric acid concentration (g/l) | — |
| Hydrogen ion concentration (pH) | 2 |
| Specific gravity (Kg/l) | 1.33 |

Table 1-continued

| | |
|---|---|
| Specific heat (Kcal/Kg° C) | 0.75 |
| Boiling point (° C) | 101 |
| Impurities content (g/l) | |
| Mg | 10.7 |
| Mn | 1.88 |
| Ca | 0.44 |
| K | 1.45 |
| Si | 0.13 |
| Na | 4.12 |

Table 2

| | | |
|---|---|---|
| Tower Diameter | | 2840 mm |
| Tower Height | | 13800 mm |
| Stack Diameter | | 1500 mm |
| Stack Height | | 5000 mm |
| Ball Outer Diameter | | 59 mm |
| Ball Wall Thickness | | 0.8 – 1.8 mm |
| Grid Height | | 1200 mm |
| Number of Packed Balls | Upper Chamber | 4000/100 mm |
| | Intermediate Chamber | 8800/200 mm |
| | Lower Chamber | 6400/160 mm |
| Grid Net | Size | 6 mm |
| | Mesh Diameter | 40 mm |

A cooling gas, which was air at room temperature, was forceably supplied at a rate of 1200 $m^3$/min toward the top of the cooling tower from a lower part of the cooling tower to be brought into cooling contact with the neutral leaching solution flowing downward in spray form thereby cooling the neutral leaching solution while removing undesirable impurities. The air flowing upward through the stack of the packing chambers was finally discharged to the atmosphere from the discharge port. Liquid in an amount of one l/day was removed by the drain separator, and no mist was found in the discharged air. The neutral leaching solution cooled during its downward flow within the cooling tower was received in the sump tank, thence to the storage tank to be mixed with the circulating electrolyte supplied from the electrolyzing section.

After such cooling treatment was carried out continuously over fifteen days, the operation of the cooling tower was ceased because the pressure loss in the cooling tower became higher than 200 mmAq. In order to remove impurities accumulating in gel form on the nets of the grids, the manhole provided at an upper part of the cooling tower was opened and the gel attaching to the spray nozzles was removed, and subsequently the gel accumulating on the nets of the grids was removed by imparting vibration by means of a wooden hammer.

In order to remove impurities depositing in gel form on the inner wall of the cooling tower, washing water was jetted by a high-speed jet pump toward the inner wall at a pressure of 40 Kg/$cm^2$ and at a flow rate of 7 1/min thereby washing away the gel, and the water containing the gel was fed from the overflow port at the bottom of the cooling tower to a sump tank so as to remove the gel. The gel settling in the sump tank was transferred to a storage tank in which the gel was cooled over five days to turn the gel into slurry and to crystallize a part of the gel. The slurry containing zinc was washed and concentrated to recover zinc, and the residue was discharged as a waste.

Table 3 shows the effect of cooling of the neutral leaching solution. Table 4 shows the percentage of the gel.

Table 3

| | |
|---|---|
| Neutral leaching solution | |
| Flow rate ($m^3$/hr) | 103 |

Table 3-continued

| | | |
|---|---|---|
| Temp. at inlet (° C) | | 60 |
| Temp. at outlet (° C) | | 36.6 |
| Cooling air | | |
| Flow rate ($m^3$/min) | | 1200 |
| Dry bulb thermometer (° C) reading at inlet | | 31 |
| Wet bulb thermometer (° C) reading at inlet | | 26 |
| Dry bulb thermometer (° C) reading at outlet | | 60 |
| Cooling effect | | |
| Cooling capacity (Kcal/hr) | | $2.42 \times 10^6$ |
| NOG | (Kcal/$m^3$ hr) | 1.96 |
| KOG | (Kcal/$m^3$ hr | 41000 |
| Concentration rate | (%) | 96 |
| Liquid-Gas ratio | (l/min) | 1.4 |
| Pressure drop (mmAq) | | 184 |

Table 4

| | ANALYSIS | | | | |
|---|---|---|---|---|---|
| product gel 450 kg/day | Zn 4.87% | Ca 20.4% | Mg 0.27% | Mn 0.09% | Si 0.05% |

The cooled neutral leaching solution was added to the circulating electrolyte which had a composition as shown in Table 5.

Table 5

| | |
|---|---|
| Zinc concentration (g/l) | 50–75 |
| Sulfuric acid concentration (g/l) | 130–200 |
| Hydrogen ion concentration (pH) | — |
| Specific gravity (Kg/l) | 1.27 |
| Specific heat (Kcal/Kg° C) | 0.84 |
| Boiling Point (° C) | 104 |
| Impurities content (g/l) | |
| Mg | 12.98 |
| Mn | 1.88 |
| Ca | 0.45 |
| K | 1.59 |
| Si | 0.11 |
| Na | 5.06 |

The circulating electrolyte mixed with the neutral leaching solution was cooled to the temperature suitable for the electrolysis carried out at current densities of 300 A/$m^2$ and 600 A/$m^2$. The second cooling tower used for cooling had dimensions as shown in Table 2 referred to hereinbefore, and the circulating electrolyte mixed with the neutral leaching solution was sprayed from the spray nozzles into the cooling tower to flow downward in spray form. A cooling gas, which was air at room temperature, was forcedly supplied upward from a lower part of the cooling tower toward the top of the cooling tower at respective rates of 6000$m^3$/min and 13,200 $m^3$/min to be brought into cooling contact with the circulating electrolyte flowing downward in spray form thereby cooling the electrolyte while removing undesirable impurities. After continuation of such manner of cooling over thirty days, the gel depositing in the cooling tower was removed. Table 6 shows the effect of cooling. Table 7 shows the percentage of the removed gel.

Table 6

| | | Current density 600A/$m^2$ | Current density 300A/$m^2$ |
|---|---|---|---|
| Circulating electrolyte | | | |
| Flow rate ($m^3$/hr) | | 2800 | 2800 |
| Temp. at inlet (° C) | | 38.6 | 36.6 |
| Temp. at outlet (° C) | | 35.5 | 35.5 |
| Cooling air | | | |
| Flow rate ($m^3$/min) | | 13200 | 6000 |
| Dry bulb thermometer (° C) reading at inlet | | 31 | 31 |
| Wet bulb thermometer (° C) reading at inlet | | 26 | 26 |
| Dry bulb thermometer (° C) reading at outlet | | 38.6 | 38.6 |
| Cooling effect | | | |
| Cooling capacity | (Kcal/hr) | $9.15 \times 10^6$ | $3.24 \times 10^6$ |
| NOG | (Kcal/$m^3$hr) | 1.61 | 1.68 |
| KOG | (Kcal/$m^3$hr) | 33700 | 35000 |
| Concentration rate | (%) | 90 | 92 |
| Liquid-Gas ratio | (l/min) | 3.6 | 7.85 |

Table 7

| | ANALYSIS | | | | |
|---|---|---|---|---|---|
| product gel 750 kg/day | Zn 1.24% | Ca 20.0% | Mg 0.29% | Mn 2.46% | Si 1.93% |

As a result of the cooling treatment in the manner above described, impurities such as Ca, Mg, Mn, K, Na and Si present in the neutral leaching solution and circulating electrolyte could be separated and removed in gel form to such an extent that these impurities did not remain in these solutions in a substantial amount. Therefore, in the example presently described, the amount of impurities remaining in the cooled circulating electrolyte could be greatly reduced compared with the prior art method. Table 8 shows the results of the electrolytic refining of zinc using a circulating electrolyte cooled by the method of the present invention.

EXAMPLE 2

FIGS. *7a, 7b, 7c* and FIGS. *8a, 8b, 8c* show the marked effects of the cooling method according to the present invention when cooling was continuously carried out over a long period of time. More precisely, FIGS. *7a, 7b* and *7c* show the results when cooling of the neutral leaching solution was continuously carried out over fourteen days, and FIGS. *8a, 8b* and *8c* show the results when cooling of the circulating electrolyte was continuously carried out over 30 days.

Table 8

| | Current density 600A/$m^2$ | Current density 300A/$m^2$ | Current density (variation) 600⇄300 A/$m^2$ |
|---|---|---|---|
| Deposition time (hrs) | 24 | 48 | 32 |
| Cell voltage (V/cell) | 3.57 | 3.25 | — |
| Current efficiency (%) | 89.5 | 91.3 | 90.5 |
| Power consumption (A.cπwh/deposit-t) | 3.340 | 2.980 | 3.130 |
| Analysis of zinc slab (%) | pb 0.0014 Cd. 0.0001 | Fe 0.0002 Cu 0.0003 | |

I claim:

1. In a method of electrolytically recovering zinc wherein a circulating zinc electrolyte solution is cooled, the improvement comprising precooling a zinc sulfate solution resulting from the leaching of zinc ore and adding the same to said circulating electrolyte at a first temperature relatively close to a second temperature suitable for electrolysis of said zinc, while, at the same time, removing impurities existing in said solution by causing the impurities to precipitate in gel form during said cooling, and then further cooling the resulting mixture of circulating electrolyte and said zinc sulfate solution to said second temperature while, at the same time, removing impurities in said circulating electrolyte precipitated in gel form during said further cooling.

2. A method as claimed in claim 1, wherein the pH value of said zinc sulfate solution is adjusted to about 1 to 3 before cooling, said solution is then cooled to about 36° C to 38° C while at the same time, removing the impurities existing therein, and subsequently said circulating electrolyte is cooled to about 35° C to 36° C while, at the same time, removing further impurities existing therein.

3. A method as claimed in claim 1, wherein means are provided for removing the impurities existing in said zinc sulfate solution and said circulating electrolyte while cooling said solutions, said means comprising a cooling tower providing a downward stream of said solutions in the form of a spray within said cooling tower, means are provided for forceably supplying an upward stream of cooling gas under pressure in counter-current relation to said downward stream of said solution and a multiplicity of balls of light weight packed in a suitable area are contained within said cooling tower, said balls being in a state of floating and rotational movement by virtue of said upwardly flowing stream of cooling gas flowing in counter-current relation to said downward stream of said solution thereby bringing said solution into cooling contact with said cooling gas, said balls further making frictional engagement with one another thereby removing the impurities precipitated from said solutions in gel form on the surface of said balls during cooling.

4. A method as claimed in claim 3, wherein a plurality of vertically arranged packing chambers are formed by a plurality of vertically spaced grids within said cooling tower to contain said balls therein in such relation that the voids of said packing chambers packed with said balls are from about 60% to 95%, and said grids are each formed by fixing a knotless net having a mesh size of from about 40 to 50 mm to a supporting frame.

* * * * *